United States Patent [19]

Bender et al.

[11] Patent Number: 4,625,106

[45] Date of Patent: Nov. 25, 1986

[54] NONLINEAR GAIN MICROCHANNEL PLATE IMAGE INTENSIFIER TUBE

[75] Inventors: Edward J. Bender, Alexandria, Va.; E. Vincent Patrick, Laurel, Md.; Richard E. Franseen, Springfield, Va.

[73] Assignee: The United States of America as represented by the Secretary of the Army, Washington, D.C.

[21] Appl. No.: 626,084

[22] Filed: Jun. 29, 1984

[51] Int. Cl.[4] ..... H01J 31/50

[52] U.S. Cl. ..... 250/213 VT; 313/467

[58] Field of Search ..... 250/207, 213 VT, 578; 313/467, 103 CM; 315/11

[56] References Cited

U.S. PATENT DOCUMENTS 4,131,818 12/1978 Wilder ..... 250/578

*Primary Examiner*—Gene Wan

*Attorney, Agent, or Firm*—Max L. Harwell; Robert P. Gibson; Anthony T. Lane

[57] ABSTRACT

A microchannel plate (MCP) electron multiplier image intensifier tube having the resistivity of the MCP channels suitably tailored to provide nonlinear gain to allow optimum viewing of scenes possessing a large dynamic range. Changes in other tube components and configurations are disclosed that simultaneously improve tube resolution and reduce the time-varying gain effects of the MCP to such a degree that these temporal effects not only do not seriously degrade the image but in fact provide useful contrast enhancement for moving parts of the image.

5 Claims, 3 Drawing Figures

NONLINEAR GAIN MICROCHANNEL PLATE IMAGE INTENSIFIER TUBE

The invention described herein may be manufactured, used, and licensed by the U.S. Government for governmental purposes without the payment of any royalties thereon.

BACKGROUND OF THE INVENTION

1. Field of the Invention

The invention relates to nonlinear gain microchannel plate (MCP) image intensifier tubes, and especially to intensifier tubes having MCPs whose resistivity is increased to yield nonlinear gain characteristics suitable for extending the tube's dynamic range and having phosphor screens whose phosphor transfer efficiency is changed to ameliorate undesirable temporal gain effects resulting from the increased resistivity.

2. Description of the Prior Art

Second and third generation wafer image intensifier goggle tubes have been used to view scenes which frequently contain a substantial fraction of bright above-horizon sky along with the much darker below-horizon ground, the latter being the area of interest. Typically, the above-horizon sky is one hundred to eight hundred times brighter than the below-horizon area of interest.

These image intensifier tubes employ an automatic brightness control (ABC) circuit in the tube power supply which acts to preserve user dark adaptation and to prevent tube damage by not allowing total current reaching the tube phosphor screen to exceed a given value. This circuit accordingly acts to reduce overall tube gain so that the average screen brightness stays below a certain predetermined value. For typical scenes which possess small or moderate ranges of brightness the ABC circuit works very well. However, for horizon scenes which possess large extremes of brightness, the bright above-horizon sky areas cause the ABC circuit to reduce tube gain for both the bright and dark scene areas. This overall tube gain reduction seriously degrades the user's capability for resolving detail in the scene dark area since detail can either be completely lost, or be discernible only after a much longer observation period.

Second and third generation wafer image intensifier goggle tubes use MCP electron multipliers. A typical prior art MCP image intensifier is disclosed in U.S. Pat. No. 3,553,518 to Pieter Schagen, patented on Jan. 5, 1971. In linear MCP operation, electrons emitted from a photocathode strike the channel walls near the input, initiating a cascade of secondary electrons which propagates through the channel and increases exponentially with each subsequent strike along the channel wall. All secondary electrons lost to this cascade from the channel surface layer are replenished by the underlying electronic conduction region such that the channel walls charge only slightly and the electric field through the channel remains uniform and constant. As the output current level in each channel increases, however, the conduction region can no longer adequately replace the electrons emitted from the surface layer. Consequently, the surface layer assumes a positive charge and causes the field through the channel to deform. The net effect of this field distortion is an overall reduction in channel electron gain. In fact, this is the point at which the channel becomes sublinear in electron multiplication. As the input current is increased, the channel gain decreases in a characteristic fashion. It is clear that the gain cannot decrease below unity on a steady-state basis, or else the channel would become an absorber of electrons and would dissipate the accumulated positive charge. However, for high input electron levels, an instability arises in the channel. This instability probably results from the fact that the secondary emission yield of the first electron impact is always greater than unity. For sufficiently high inputs, however, this first strike yield cannot be sustained in that the average channel gain must approach unity as the input current increases. Consequently, the channel gain must oscillate as a function of time. This channel instability cycle causes the net electron multiplication of the channel to continue falling asymptotically towards unity as input electron levels increase and consequently, the time-averaged net electron multiplication from the channel can fall below the value of first strike secondary yield. The frequency and amplitude of this field instability cycle are dependent upon the input electron levels and the resistivity of the channel.

Saturation characteristics, such as those just explained, were measured for several MCP types over a range of electron gains and strip current densities. Typical characteristics are as shown in TABLE I:

TABLE I

| MCP Type | Strip Current Density (Amperes/cm$^2$) At Typical Voltages | Electron Gain | FOM | $\gamma$ |
|---|---|---|---|---|
| Unfilmed | $5 \times 10^{-9}$-$2 \times 10^{-7}$ | 200–1000 | .4–.6 | .2–.4 |
| Filmed | $4 \times 10^{-7}$ | 800 | .55 | .3 |
| Filmed Funneled Coated | $1$-$3 \times 10^{-7}$ | 200–900 | .2–.3 | .4 |

Specific characteristics of the MCP types were as follows. The filmed MCP had an approximately 50 Å layer of either aluminum oxide or silicon dioxide placed over the input channel openings to prevent ion feedback. The filmed funneled coated MCP had, in addition to the above, its channel walls thinned at the input to increase the fraction of signal electrons entering the channels and had a coating of high secondary emission material, i.e., magnesium oxide, placed on input channel surfaces to improve electron multiplication. It should be noted that the figure-of-merit (FOM) of the MCP saturation characteristic is defined as a particular output current density Jout value at the knee of a characteristic curve, i.e. the Jout value at the intersection of the extrapolations of the linear gain and sublinear region as discussed herein above, divided by strip current density $J_{st}$ which represents the channel wall conduction current per unit area, expressed in amps/cm$^2$. The gamma characteristic $\gamma$ represents the log-log slope of the sublinear region, and assumes a value between zero and unity.

Initial attempts to utilize nonlinear gain characteristics caused by substantially increased resistance of the prototype MCPs resulted in undesirable temporal characteristics. These temporal characteristics were not only cosmetically distracting, but also severely degraded tube imagery. The temporal effects that are the primary design constraints are categorized as follows.

The first temporal effect is gain recovery time. This time effect manifests itself as a band which appears when the tube is scanned across a bright/dark interface of a scene. The band originates at this interface and may be either brighter or darker than its surroundings, depending on the direction in which the tube is scanned across the interface. The width of the band is proportional to the rate of the scan. The appearance of this transient response is a shimmering or waviness of bright/dark interfaces which can readily induce discomfort and/or disorientation in the user.

A second temporal effect problem is bright borders. This effect appears as a bright outline which forms at a stationary, sharply-demarcated bright/dark interface. The bright outline forms over the course of approximately one minute, and if the bright/dark interface is displaced after this period the bright border will persist in its original position for over a minute before fading away. Although this time effect is very noticeable in static laboratory tests, it is not evident in field tests. This is because the bright/dark interfaces in the field are neither sharp enough nor of sufficiently high contrast to induce the effect, and also because there is always enough image motion in the field environment to prevent the burn-in of interface outlines required for the effect to occur.

Travelling waves are a third temporal effect problem. This problem only occurs when the tube is scanned over a bright/dark interface such that a dark area is moved into a previously bright area on the tube. It manifests itself as several dark bands or waves which originate in the bright region on the tube and travel toward the interface for one or two seconds after the scan is completed. This is perhaps the most serious time effect because it occurs very frequently in typical horizon scenarios and can be extremely distracting to the user.

Rippling is the fourth problem. This problem occurs only when there are very bright light sources in the scene, and it manifests itself as a steady movement of dark ripples or waves across the bright areas. Unlike travelling waves, the rippling requires no image motion or scanning to be initiated, and it persists for as long as a sufficiently bright area remains on the input of the tube. Since there are many very bright sources in typical field scenarios (e.g., headlights, floodlights, flares) rippling constitutes a definite design constraint.

These limitations, disadvantages and problems inherent in the prior art are overcome by the present invention.

SUMMARY OF THE INVENTION

A feature of the present nonlinear gain image intensifier tube is retention of full tube gain in the dark areas of a horizon scene in the presence of a much brighter area above the horizon, where the above-horizon area may be up to 800 times brighter than the below-horizon area. The electrical properties of the nonlinear gain image intensifier MCP are tailored to give full gain in the below-horizon area and channel saturation for reduced amplification only in the above-horizon areas, thus extending the image intensifier's dynamic range. The change in MCP electrical properties is not sufficient in itself, because the needed resistivity for extended dynamic range is approximately 32 times higher than standard MCP resistivity values. It is this high resistivity that causes the previously mentioned unacceptable temporal gain effects. However, if the resistivity is reduced by a factor of about 5 from this original high value while still retaining the same tube gain characteristics with regard to light amplification, not only are the temporal effects minimized as problems, but one temporal effect actually becomes a source of beneficial image contrast enhancement. Refer to TABLE II below for typical values of the strip current density ranges. In order to retain this suitable tube light amplification with the reduced resistivity of the new nonlinear gain MCP, it is necessary to increase the linear MCP electron gain by the same factor while simultaneously reducing by this factor the tube's net phosphor transfer efficiency, i.e. its output luminous flux per unit input current, in terms of lumens/amp. The MCP resisitivity and linear electron gain are the sole determinants of the electron gain transfer curve and can be adjusted to counterbalance each other, but the intensifier's light amplification is further determined by the tube phosphor transfer efficiency, which must be adjusted in reference to the other two. The introduction of phosphor transfer efficiency as a design variable is the second novel feature of the invention.

TABLE II

| STRIP CURRENT DENSITY AT STANDARD VOLTAGE (amps/cm$^2$) | |
|---|---|
| STANDARD PRODUCTION MCP RANGE | $1.05 \pm .75 \times 10^{-6}$ |
| NLG/MCP: UNSATISFACTORY TRANSIENT RESPONSE | $3.25 \pm .65 \times 10^{-8}$ |
| NLG/MCP: SATISFACTORY TRANSIENT RESPONSE | $1.75 \pm .50 \times 10^{-7}$ |

The phosphor transfer efficiency may be lowered in many ways. Three means for lowering the phosphor transfer efficiency are as follows. The first and probably simplest means is to evaporate a thicker metallic layer over the phosphor screen material of the tube, and leave all other mechanical and electrical parameters of the tube unchanged. The prime advantage of evaporating a thicker metallic layer is its simplicity, but it has no other significant benefits except for a reduction in light feedback through the phosphor's metallic overlayer because of its greater thickness. The second means is to use an intagliated fiber optic phosphor screen. An intagliated phosphor consists of a fiber optic faceplate which is preferentially etched to yield a uniform matrix of pits or cells in the core of the fibers. The walls of these cells, i.e. the cladding glass of the fibers, are then metallized to make them reflective, and phosphor is then deposited in the metallized cells. A metallic layer is then deposited over the input to the cells. The resulting phosphor screen is inherently lower in phosphor transfer efficiency because the phosphor material is deposited only in the etched core glass cells, which comprise only about 60% of the fiber optic faceplate area. The fact that phosphor particles must be somewhat smaller to allow efficient packing into the cells also acts to reduce the net phosphor transfer efficiency. However, an intagliated phosphor acts to substantially improve tube resolution because all of the light emitted from a cell's phosphor material is reflected down into the core of the fiber under that cell. A standard phosphor screen, in contrast, allows for light emitted over one fiber to enter adjacent fibers. Consequently, the use of an intagliated phosphor screen in a nonlinear gain MCP tube not only provides the needed reduced phosphor transfer efficiency, but also provides the added performance benefit of improved tube resolution. A third means which could be the most preferred way for reducing phosphor transfer efficiency is to simply reduce the spacing between the MCP output and the phosphor screen while leaving both the phosphor screen and the field strength between the MCP and screen unchanged. This configuration provides reduced phosphor transfer efficiency because the electrons striking the screen have a lower landing energy and less effectively penetrate the metallic overlayer of the phosphor screen. The reduced spacing configuration should also improve the tube resolution, since resolution is a monotonically decreasing function of the spacing between the MCP and phosphor for constant electric field strength. As in the case with the intagliated phosphor screen, the reduced spacing configuration should improve the nonlinear gain MCP tube resolution while providing the necessary reduced phosphor transfer efficiency.

By making the indicated changes to MCP resistivity, MCP electron gain and the phosphor transfer efficiency, one temporal gain effect is made into an advantage. That effect is the gain recovery temporal effect which imparts either a bright or dark outline around moving bright dark interfaces, the outline being either brighter or darker than either of the interface components and thus tending to more clearly define each component. Since there is almost always some image motion in the field environment because of movement either of the scene or the user, the gain recovery effect is prevalent and thus an important source of beneficial contrast enhancement for the user. Tests have shown that the gain recovery effect can produce up to a 100% improvement in resolution for low contrast scene imagery. It should also be noted that the gain recovery effect is an important counteraction to the reduction in image contrast which necessarily occurs where the MCP transfer characteristic is sublinear.

DETAILED DESCRIPTION OF THE PREFERRED EMBODIMENT

Figure 1:
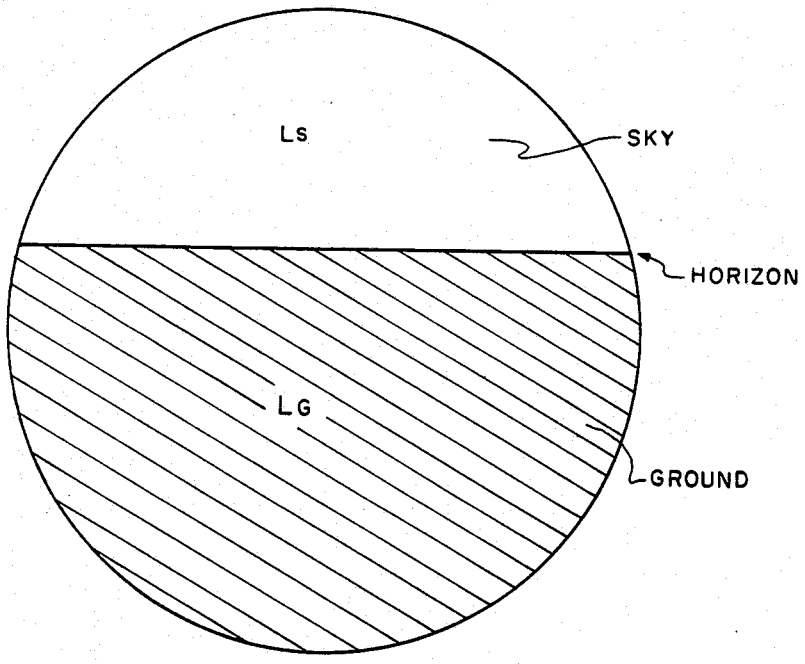
FIG. 1 illustrates a typical horizon scenario and depicts the darker below-horizon area and the brighter above-horizon area.

Refer to FIG. 1 first to review a typical scene. These scenes contain a substantially higher above-horizon sky brightness, represented by $L_s$, compared to the much darker below-horizon ground, represented by $L_G$. The $L_s$ is typically one hundred to eight hundred times higher than the $L_G$ value.

The automatic brightness control (ABC) circuits used in wafer image intensifier tubes prevent damage to the tube by limiting the total current reaching the tube phosphor screen wherein the average screen brightness stays below a predetermined value. For scenes that have small or moderate ranges of brightness the ABC circuits work well, but when there are extreme ranges of brightness in a given scene the ABC circuit reduces gain for both the bright and dark areas of the scene. This gain reduction seriously degrades the user's capability for resolving detail in the scene dark area.

Figure 2:
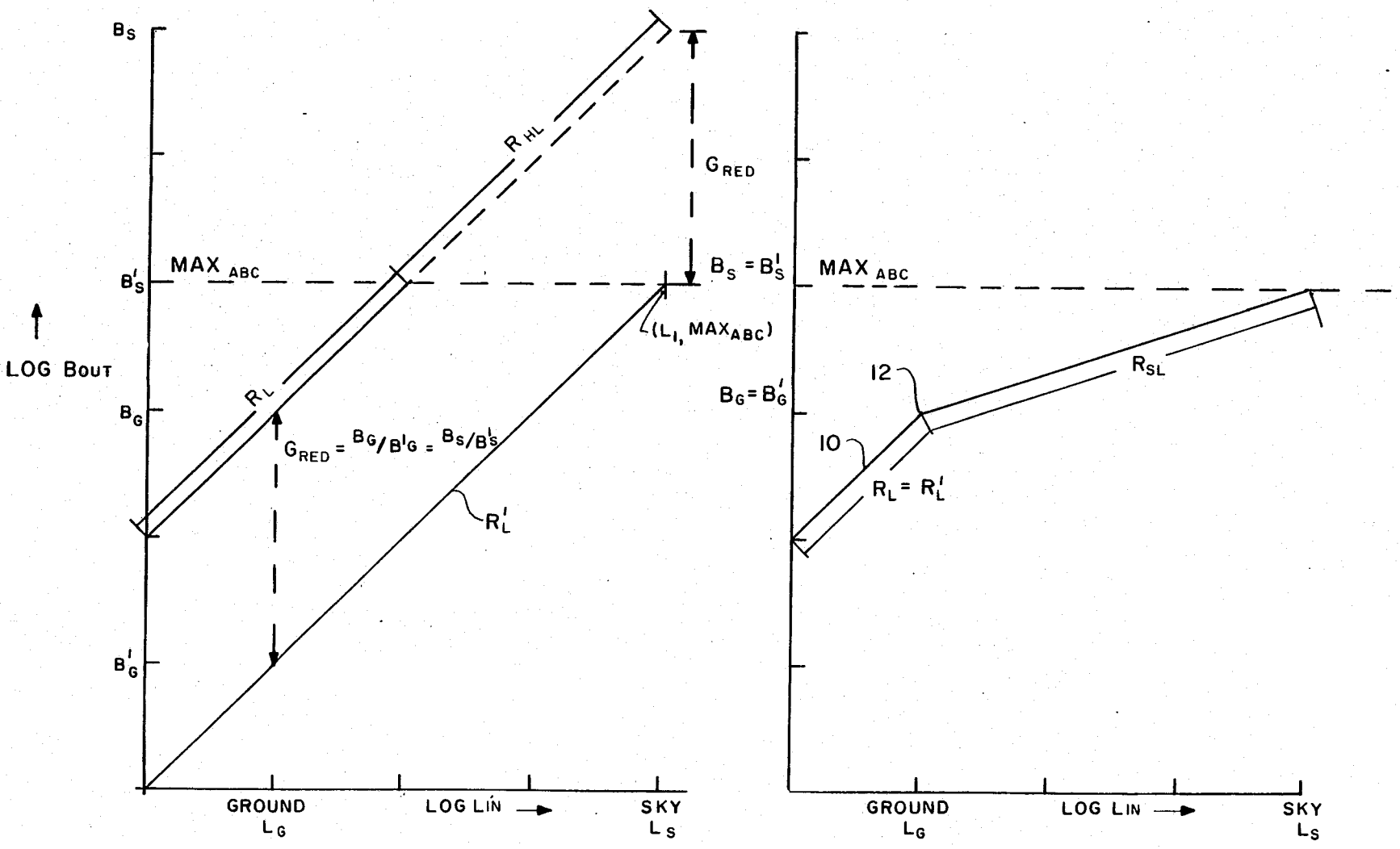
FIG. 2 shows a log input illumination to log output brightness graph of standard image intensifier operation and the present nonlinear gain MCP image intensifier operation.

Refer now to FIG. 2 for one explanation of the characteristic curve of prior art image intensifier tubes with ABC circuits on the left side versus the characteristic curve of the present nonlinear gain MCP image intensifier tube with an identical ABC circuit on the right side. The horizontal scale is a base ten logarithm of the light intensity input represented by Lin to the tube. The vertical scale is a base ten logarithm of the output brightness of the tube, represented as $B_{OUT}$. The $MAX_{ABC}$ line across both characteristic curves represents the maximum value of output brightness allowed by the ABC circuit.

Look now more closely to the left side of FIG. 2 for an explanation of how the ABC circuit reduces the overall gain or output brightness of the image intensifier tube. The graph of the intensifier gain without the ABC circuit is shown in two parts, $R_L$ and $R_{HL}$, the latter part representing the section of the graph for which the output brightness exceeds $MAX_{ABC}$. The ABC circuit detects the output brightness averaged over the area of the output display. The action of the ABC circuit is to limit the averaged output brightness to no greater than $MAX_{ABC}$ by adjusting the microchannel plate voltage, and hence the microchannel plate electron gain. The ABC circuit thus operates to reduce intensifier gain such that any averaged output brightness that would otherwise lie on segment $R_{HL}$ does not exceed $MAX_{ABC}$. The difference between the point on the segment $R_{HL}$ and $MAX_{ABC}$ for a given averaged input corresponds to the factor $G_{RED}$ by which the ABC circuit reduces the intensifier's gain. If the ABC circuit is active and if the intensifier is uniformly illuminated, the graph of the input versus the output would then coincide with $R_L$ and the section of the horizontal line $MAX_{ABC}$ that is below $R_{HL}$. Assume now that the intensifier with ABC is illuminated with a non-uniform input such as in FIG. 1, and such that the averaged input illumination and the averaged output brightness correspond to the point ($L_1$, $MAX_{ABC}$) on the graph. It can be seen that the ABC has reduced the intensifier output brightness for the scene sky area to $B'_S$ from what it would have otherwise been, i.e. $B_S$, by lowering the intensifier gain by a factor of $G_{RED}$. However, the intensifier continues to operate as a linear amplifier for variations in the scene about the average $L_1$ of this non-uniform scene. The graph of the inut versus the output for each point in the scene, when the averaged input is $L_1$, is given $R'_L$. The problem of the prior art image intensifier tube having only the ABC circuit to limit scene brightness is that the output brightness of the below-horizon area is substantially lowered from a brightness $B_G$ to a brightness $B'_G$ in this scenario. The brightness $B_G$ represents output brightness of the below-horizon area at full intensifier gain without the ABC circuit activated. The reduced output brightness $B'_G$ may not be sufficient to determine important information.

Review the right side of FIG. 2 for the same horizon scene as on the left side but with the present nonlinear gain MCP image intensifier tube used to produce a sublinear portion $R_{SL}$ starting at the knee 12 of the transfer characteristic curve $R_L$. The FOM is associated with the knee 12 as previously described in the BACKGROUND. The nonlinear gain image intensifier tube provides linear amplification for scene illuminations up through that of the below-horizon light intensity, i.e. $L_G$. However, at higher input illuminations the MCP enters channel wall saturation as described above and its gain characteristic becomes sublinear, thus providing amplification that decreases for increasing values of input illumination. The sublinear response occurs only in the areas of high input illumination, and is therefore called local saturation. This MCP saturation characteristic is determined by suitable choice of MCP resistivity so that in a typcial horizon scene, the amplification is only reduced for the much brighter above-horizon sky areas, with the reduction in amplification being sufficient to prevent the above-horizon image brightness $B_S$ from exceeding the $MAX_{ABC}$. As a result of the individual channels of the MCP being locally saturated, the tube ABC circuit is not activated in the typical horizon scene and full image intensifier tube gain is retained in the scene areas where it is needed most, i.e. in the dark below-horizon scene area. Consequently the horizon scene gain characteristic $R'_L$ is the same as the full gain characteristic $R_L$, and horizon scene output brightnesses $B'_S$ and $B'_G$ are not reduced by the tube ABC circuit. The $R_{SL}$ portion of the gain characteristic curve of FIG. 2 reflects local saturation of the channels which are viewing the much brighter above-horizon scene area.

Figure 3:
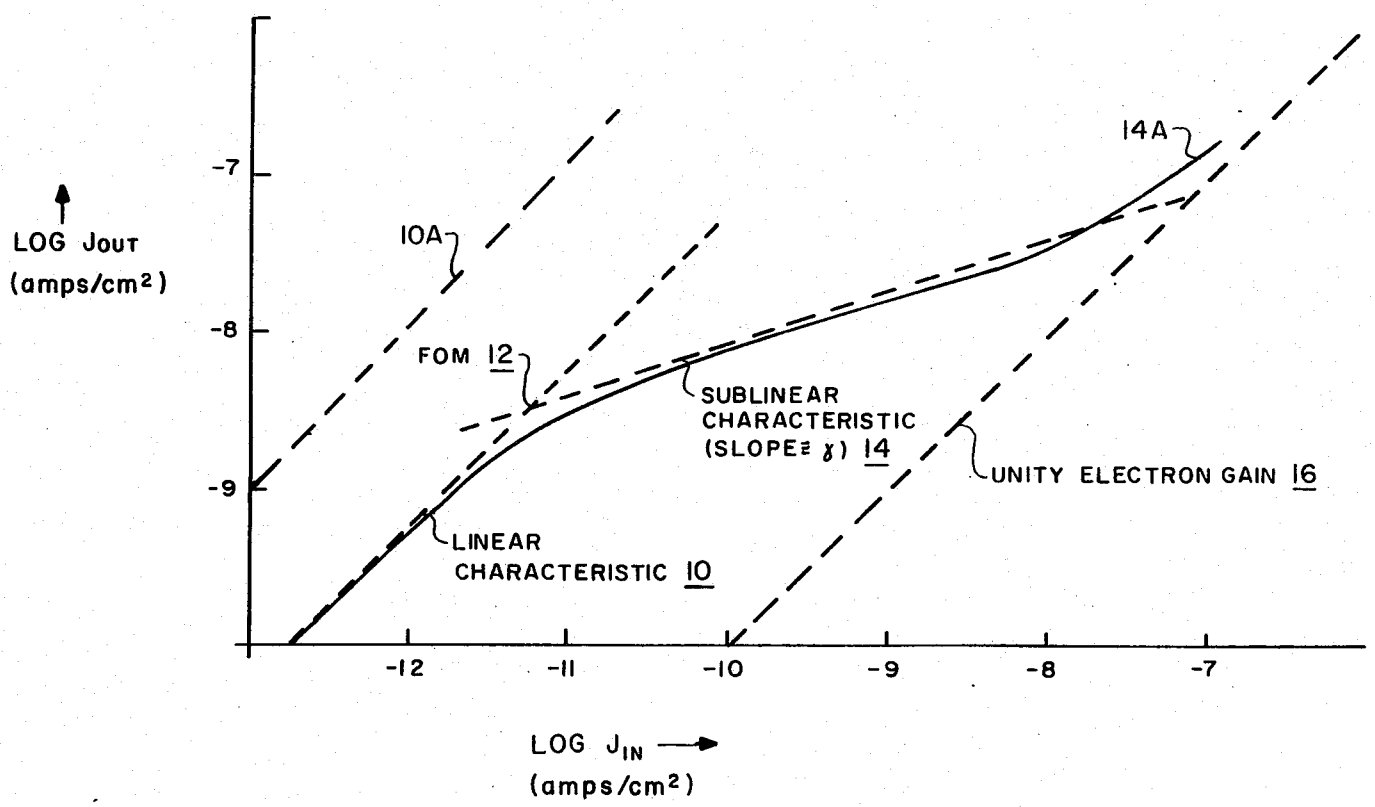
FIG. 3 illustrates a log input current density to log output current density graph of a typical MCP gain saturation characteristic.

The MCP gain saturation characteristics which account for the linear and sublinear characteristics of the nonlinear gain image intensifier tube are shown in more detail in FIG. 3. It should be noted that MCPs, regardless of resistance, possess an electron multiplication, i.e. gain characteristic, which can be accurately depicted on a graph of the base ten logarithms of output current density, log $J_{OUT}$, versus input current density, log $J_{IN}$, as a curve having three distinct regions. At output current densities which are much lower than the strip current density $J_{ST}$, the characteristic curve is a straight line inclined at 45° to either axis, with its axis intercepts determined solely by the potential applied across the MCP. This characteristic 10 is simply the input-output characteristic of a linear device. As Jout approaches the magnitude of $J_{ST}$, however, the characteristic gain curve begins to bend downward into a second region of decreased slope from the unity slope of 10. This second area is a sublinear gain region which can be approximated by dashed line 14 whose slope is referred to as gamma $\gamma$, where $\gamma$ assumes a value between zero and unity. The sublinear characteristic 14 is produced by the intrachannel field distortion discussed herein above which causes the channel amplification characteristic to become sublinear. The sublinear region extends in approximately a straight line for several decades of input current density until the electron gain is reduced to a value in the range of 10 to 50. At this point, the gain characteristic begins to bend upward into a third region where the electron gain asymptotically approaches unity. The unity electron gain characteristic is represented by 16.

The actual plotted gain saturation characteristics are approximately as shown by solid curve 14A in which region 14 is projected outward to region 10 along an extension of the straight sublinear portion of 14A. In other words, the straight dashed line 14 would in reality be essentially an overlay of the plotted solid curve 14A. The FOM point 12 is derived from extrapolation of the linear and sublinear regions 10 and 14 respectively. Linear characteristic 10 represents a given electron gain for a particular MCP, say in this case a gain of 800. The sublinear characteristic 14 then represents a gains ranging from a little less than 800 down to about 10, where the third region of the characteristic then asymptotically approaches unity electron gain. Linear characteristic 10A is also shown to illustrate a higher gain of say 10,000.

By modifying the reduction process of a particular MCP to increase $J_{ST}$, the sublinear characteristic line 14 is moved upward. Line 14 moves up because the FOM is for practical purposes a constant, in that it characterizes the condition where charge depletion begins to influence the gain as was discussed earlier. Recall that the FOM is defined as Jout at the intersection of the extrapolations of the linear region and the sublinear region divided by Jst, which is now larger. Therefore the intersection point of the extrapolations must move upward. Notice that changing $J_{ST}$ does not affect the location of 10 or 16. When $J_{ST}$ is increased the resitivity and associated temporal effects are decreased accordingly. The lowering of the phosphor transfer efficiency lowers the output brightness value which corresponds to a given output current density value on the MCP gain characteristic.

It should be noted that the dynamic range of sublinearity is determined solely by the MCP linear gain. For practical purposes, $\gamma$ and FOM are constants. In FIG. 3, for a fixed MCP, $J_{ST}$ differs very slightly between gain curve 10 and 10A. It follows that the sublinear region corresponding to 10A is approximated by a line of slope $\gamma$ extending from 10A to 16. This line intersects 10A with ordinate equal to that of point 12. Similar to 14A, the actual gain approaches 16 asymptotically.

We claim:

1. A nonlinear gain microchannel plate image intensifier tube which provides varying amounts of amplification across scenes having large extremes of brightness, said tube comprising:

a microchannel plate havings its resistivity reduced and its linear electron gain increased by the same factor as the reduced resistivity to provide transfer characteristics comprised of fast decay rates of transient responses over predetermined input and output dynamic ranges, said microchannel plate having an input-output transfer function typical of microchannel plates in strip current saturation so that said transfer function is comprised of a low input linear gain region, a middle nonlinear gain region with log input-log output slope less than unity to provide automatic image intensifier automatic brightness control, and a high input region asymptotically approaching unity gain, wherein each channel of said microchannel plate acts in the steady state case as an independent amplifier and its gain is determined solely by the input to that channel, said resistivity and linear gain of said microchannel plate are chosen so that the transfer is linear over a predetermined low input range and is nonlinear with log input-log output slope less than unity over a predetermined middle input range wherein the resisitivity is low to obtain the desired fast decay rates for transient responses and the linear gain is high to meet predetermined intensifier gain; and a phosphor screen having its phosphor transfer efficiency treated as a dependent variable of said intensifier tube wherein the value of said dependent variable is determined by the desired overall system gain and a chosen linear gain of said microchannel plate.

2. A tube as set forth in claim 1 wherein said dependent variable of the phosphor transfer efficiency is provided by variation of the thickness of a metallic layer over said phosphor screen.

3. A tube as set forth in claim 1 wherein said dependent variable of the phosphor transfer efficiency is provided at least in part by use of an intagliated fiber optic phosphor screen.

4. A tube as set forth in claim 1 wherein said dependent variable of the phosphor tranfer efficiency is provided by a reduced spacing between the output of said microchannel plate and said phosphor screen while the electric field strength therebetween remains constant.

5. A tube as set forth in claim 1, wherein said intensifier tube automatic brightness control is performed solely by the nonlinear transfer function of the microchannel plate within individual channels of the microchannel plate until the total output current of said individual channels exceed a threshold defined in terms of the nonlinear transfer curve of the microchannel plate.

* * * * *